United States Patent [19]

Heikens et al.

[11] 4,443,527

[45] Apr. 17, 1984

[54] COLORED MAGNETICALLY ATTRACTABLE TONER POWDER, ITS PREPARATION, AND DEVELOPING IMAGES WITH SUCH POWDER

[75] Inventors: Harm H. Heikens, Reuver; Gerardus J. Crommentuyn, Lottum, both of Netherlands

[73] Assignee: Océ-Nederland B.V., Venlo, Netherlands

[21] Appl. No.: 414,501

[22] Filed: Sep. 2, 1982

[30] Foreign Application Priority Data

Sep. 18, 1981 [NL] Netherlands ..... 8104307

[51] Int. Cl.[3] ..... G03G 9/08; G03G 9/14

[52] U.S. Cl. ..... 430/39; 430/106; 430/106.6; 430/137; 428/407

[58] Field of Search ..... 430/106, 106.6, 137, 430/39

[56] References Cited

U.S. PATENT DOCUMENTS 3,639,245 2/1972 Nelson .
3,816,117 6/1974 Kankeinen ..... 430/66 X
3,925,219 12/1975 Strong .
4,013,783 3/1977 de Putter et al. .
4,189,390 2/1980 Noguchi et al. .
4,238,562 12/1980 Ishida et al. ..... 430/106

FOREIGN PATENT DOCUMENTS 51-42539 4/1976 Japan .
1169703 11/1969 United Kingdom .
2021794 12/1979 United Kingdom .
2026506A 2/1980 United Kingdom .

OTHER PUBLICATIONS

Early-Disclosure Patent Gazette Japan No. 76-46131, Hitachi KK 18.10.74-Japan 119200.

*Primary Examiner*—Roland E. Martin, Jr.
*Attorney, Agent, or Firm*—Albert C. Johnston

[57] ABSTRACT

Colored magnetically attractable toner powder for the development of latent electrostatic or magnetic images consists of particles each comprising a magnetically attractable core, preferably spherical, formed of particulate magnetically attractable material or of a dispersion of such material in a binder, a masking layer enveloping the core and containing binder mixed with light-reflecting pigment of submicron particle size, and coloring material applied in and/or onto the masking layer. Processes for preparing the toner powder are disclosed, and a process for developing electrostatic or magnetic latent image patterns by its use.

25 Claims, No Drawings

COLORED MAGNETICALLY ATTRACTABLE TONER POWDER, ITS PREPARATION, AND DEVELOPING IMAGES WITH SUCH POWDER

This invention relates to coloured magnetically attractable toner powder consisting of particles comprising binder, magnetically attractable material and colouring agents.

The invention also relates to the preparation of a coloured toner powder of this kind and to a process for making electrostatic charge patterns visible by means of such toner powder.

Electrostatic charge patterns can, for example, be produced by means of one of the generally known electrophotographic copying processess, e.g. xerography, or by means of a stylus as used for example in a computer printout. The resulting charge pattern can be made visible by means of a toner powder which, in one of the ways known per se, can be brought into contact with the charge pattern to be developed. Toner powders of this kind usually consist of finely divided particles containing a binder and colouring agents.

The toner particles of the toner powder frequently contain magnetically attractable material so the toner powder can be fed by magnetic conveyor means to the latent charge pattern to be developed. Iron powder, chromium dioxide, or a ferrite is usually used as magnetically attractable material.

Toner powders of this kind are described, for example, in U.S. Pat. Nos. 3,639,245, 3,925,219 and 4,189,390.

Considerable problems, however, occur with such toner powders if they are required with a colour other than black, e.g. red, yellow, blue or green. Those materials which are preferably used because of their high degree of magnetisability, e.g. iron powder or ferrites, are very dark to black in colour so that they have an adverse effect on the final colour of the toner particle. It is therefore not possible directly to obtain toner particles having a clean brilliant colour.

Various toner powders have already been proposed in which the above objection is reduced.

For example, Japanese patent application No. 76/42539 describes magnetically attractable toner powders in which the toner particles comprise a transparent polymer, colouring material (other than black), and magnetically attractable constituents the surface of which is covered with a transparent or semi-transparent colouring agent. The choice of the magnetically attractable material depends on the colour that the toner powder is finally to be given.

Japanese patent application No. 76/46131 describes toner powders whose magnetically attractable material is covered with a white substance chemically deposited thereon or mixed, together with a resin, with the magnetically attractable material. The magnetically attractable material thus treated is coated with a polymer of the finally required colour.

However, it proved to be impossible to obtain fixed images having really brilliant colours with these known toner powders. Moreover the composition of the toner powders according to the first Japanese patent application has the drawback that the magnetically attractable material must be selected according to the colour finally to be given to the toner powder. The choice of different magnetically attractable materials for the preparation of toner powders of different colours may give rise to problems, more particularly if it is desired to use these toner powders with the same result in one and the same developing unit, as is usually the case in practice.

To coat fine magnetically attractable particles chemically with white substance as proposed in the second Japanese patent application requires complicated techniques and it is therefore unattractive in practice. If the magnetically attractable particles are prepared by dispersing dark magnetically attractable material together with white substance in a resin solution, evaporating the solvent, and grinding the solid mass to particles of the required size, the resulting particles are not of a bright whiteness but of a grey shade, the reflectance of which is usually much less than 20%. It is not possible to obtain brilliantly coloured toner powders from such particles.

The object of this invention is to provide a coloured magnetically attractable toner powder without the above disadvantages, the powder being particularly distinguished in that it allows the production of copies having at choice clean brilliant colours or pastel colours of any desired shade.

The toner powder according to the invention consists of toner particles comprising:

a. a magnetically attractable core, b. a masking layer enveloping the magnetically attractable core and comprising binder and reflecting pigment, c. colouring agents present in and/or on the masking layer.

The magnetically attractable core of the toner particles according to the invention may consist of one single magnetically attractable particle or of binder containing magnetically attractable particles. The magnetically attractable particles may consist of materials known for use in toner powders, or of mixtures thereof, e.g. iron, nickel, chromium dioxide, gamma-ferrioxide and ferrites of the formula $MFe_2O_4$, in which M represents a bivalent metal e.g. iron, manganese, nickel or cobalt, or a mixture of metals of other valency. Other examples are the rare-earth iron garnets of the formula $R_3Fe_5O_{12}$, in which R denotes a rear-earth or other trivalent ion e.g. Y or Sc. The iron in these garnets can also be partially replaced by other ions. It is an advantage of the invention that the choice of magnetically attractable material is independent of its colour.

Any binder in the magnetically attractable core may be selected from the polymers known from that purpose. Examples of suitable binders are polystyrene, polyvinyl chloride, polyacrylates and polymethacrylates, polyester resins, polyamides and epoxy resins. Of course mixtures of two or more binders can also be used. The content of magnetically attractable material in the core consisting of binder and magnetically attractable particles may be between 10 and 90% by weight, depending upon the magnetic properties of the selected magnetically attractable material and upon the use for which the toner powder is intended. The magnetically attractable material content will generally be between 40 and 80% by weight. The size of the magnetically attractable core is within the order of approximately 5–50 μm conventional for toner powders and is preferably 8–20 μm. If the core consists of binder and magnetically attractable material the particle size of the magnetically attractable material is generally between 3 and 30 μm, preferably between 6 and 15 μm. If the cores consist of binder and magnetically attractable material, preference is given to cores in which the magnetically attractable material is completely enveloped with binder, because the useful effect of the masking layer to be applied is maximum in such cores. This useful effect even increases if the magnetically attractable material present is of a size of at least 6 μm and/or the cores are spherical or substantially spherical.

The masking layer applied around the magnetically attractable core is built up mainly of binder and finely divided particles of one or more reflecting pigments. It serves to nullify completely or as much as possible the adverse effect of the magnetically attractable material in the core on the final colour of the toner particles. The masking effect of the said layer depends, inter alia, on the reflecting character of that layer, and this is in turn dependent on the relative refractive index $N_{pigment}/N_{binder}$, the particle size of the reflecting pigment and the structure of the layer. Since the refractive index of the most usual binders is generally between 1.45 and 1.70, the relative refractive index of the masking layer is determined by the refractive index of the pigment or mixture of pigments used. To obtain the maximum possible reflective effect, therefore, it is primarily desirable to select a pigment having a high refractive index, preferably of at least 2.

Both reflecting coloured pigments and white pigments may be used. Examples of coloured reflecting pigments that have proved usable are the lead chromates, lead molybdates and cadmium sulphide. Organic pigments coated on inorganic pigments have also proved usable, e.g. Segnale Light Yellow $T_3G$ and Segnale Light Yellow $T_2R$ (both of Messrs. ACNA, of Milan). Examples of usable white pigments are zinc oxide, antimony oxide and zirconium oxide. Preference is given, however, to titanium dioxide as the white pigment, more particularly titanium dioxide in the anatase or rutile form, having a refractive index of 2.55 and 2.70 respectively.

In order to obtain an optimum reflecting effect, the reflecting pigment must not be present in the form of agglomerates and the primary particles must be distributed as homogeneously as possible in the binder. The particle size should preferably be not more than a few tenths of a micrometer. Pigment particles of about 0.2 μm generally give the best results.

The same binders as noted hereinbefore in respect of the core can be used as binder for the masking layer. If, however, the colouring agents by means of which the final required colour is imparted to the toner particles are embedded in the surface of the masking layer or if they surround the masking layer in the form of a fairly thin pigment-binder layer, a thermoplastic binder must be used for the masking layer if the images developed with the toner powder are to be fixed by heating.

The thickness of the masking layer can vary within wide limits. It is generally between 2.5 and 7.5 μm.

The colouring agents by means of which the toner particles are given the finally required colour, hereinafter referred to as "dyeing" may be applied directly in and/or on the masking layer of the toner particles. Alternatively they may be applied in the form of a layer enveloping the masking layer and containing a binder having the finely divided or dissolved colouring material therein. In the latter case, a thermoplastic material must be used as binder for the reason already indicated. The thickness of a pigment-binder layer of this kind may be within wide limits. Colouring layer having a thickness of between 2 and 5 μm have proved satisfactory.

Both inorganic or organic pigments and dyes or combinations thereof may be used as colouring agent for the toner powder according to the invention. Those skilled in the art will be familiar with the selection criteria. For example, preference is given to colouring agents having good temperature stability, a high brightness and strong colouring power. The pigments should not bleed out and they should have adequate dispersability and hiding power. Details on these factors can be found in inter alia Pigment Handbook, edited by T. C. Patton, Vol. 1 (1973), and O. Lückert, Farbe and Lack, 80, 11 (1964), pages 1044–1053, and in the Colour index.

A number of examples will now be given in respect of pigments and dyes usable in the toner powder according to this invention. This list has no limiting force.

A. Red colouring pigments

Insoluble azo pigments such as toluidine red (PR3, CI 12120), para red (PR 1, CI 12070) and chlorinated para red (PR 4, CI 12085). Naphthol red pigments, such as pigment red 2 (CI 12310), pigment red 5 (CI 12490), pigment red 14 (CI 12380), pigment red 17 (CI 12390), pigment red 18 (CI 12350), pigment red 22 (CI 12315), pigment red 23 (CI 12355), pigment red 31 (CI 13360) and pigment red 112 (CI 12370). Lithol red pigments such as sodium lithol red (PR 49), barium lithol red (PR 49:1), calcium lithol red (PR 49:2). Anionic azo-dyes, such as the rubines: lithol rubine PR 57 (CI 15850) and calcium red (PR 52, CI 15860), manganese red (PR 52, CI 15860), the group Permanent Red 2B, such as barium red 28 (PR 48:1, CI 15865), calcium red 2B (PR 48:1, CI 15865), and manganese red 2B (PR 48:4, CI 15865). Polycyclic pigments, such as Alizarine lake (PR 83, CI 58000:1), Thioindigo pigments (PR 86,87,88,181,198), VAT-pigments such as the perylene pigments (e.g. PR 123, 149, 179,190), and the non-perylene pigments (e.g. PR 177), and Chinacridon pigments (PR 122, 192,209). Inorganic pigments, such as cadmium selenide, iron oxide, and various chromates.

B. Blue colouring pigments

Copper phthalocynanine (PB 15, CI 74160), Iron blue (PR 27, CI 77510), Ultramarine blue (PB 29, CI 77007), Cobalt blue (PB 28, CI 77346) and Dianisidine blue (PB 25, CI 21180). Basic dye pigments (basic dyes which have reacted with complex or heteropoly acids, such as phosphotungstic acid and phosphomolybdic acid), alkali blue pigments (PB 18,19), and VAT-pigments (PB 21,22,60,64).

C. Green colouring pigments

Halogenated copper phthalocyanines (PG 7, 37), chromium green and Pigment green B (PB 8).

D. Yellow colouring pigments

Hansa yellow (CI 1168), Benzidine yellow (CI 21090), Azo-pigments (CI 13096), Anthrapyrimidine (CI 6842), Nickel titanium yellow (CI 77788), Chromate pigments (CI 77603) and Iron oxide yellow (CI 77492).

The inorganic pigments, which are frequently less attractive in terms of toxicology and/or ecology, although they are opaque, may be replaced, for example, by a series of Solintor pigments made by Messrs. Intorsa, of Barcelona, such as Solintor Red RN (PR 3), Solintor Lake Red LC-O (PR 53) and Solintor Scarlet RN. Equally well usable is a series of azo-pigments made by Messrs. Hoechst, e.g. Permanent red F3 RK 70 (PR 170), Permanent orange RL 70 VP (PO 34), Permanent orange HL 70 VP 244 (PO 36), Permanent yellow NCG 70 (PY 16), Permanent yellow HR 70 VP 253 (PY 83) and Acetanil yellow 2GO 768 (PY 74) made by Messrs. Capelle. These pigments have a lower specific area than the pigments referred to hereinbefore and therefore a larger average particle size.

Very good results can also be obtained using dyes instead of pigments in coloured toners. As contrasted to colouring pigments, dyes are dissolved in the binder medium, usually a resin.

Examples of suitable dyes are:

Red dyes:

New Magenta (CI 42520), Chromoxane Brilliant Red (CI 45180), Erosine (CI 45380), Rhodamine B (CI 45170), Rhodamine 6 GDN (CI 45160), Rhodamine F4GDN (CI 45160), Rhodamine B Extra (CI 45170), Rhodamine 6G (CI 45160), Rhodamine F5GL (CI 45160), Para Rosaniline (CI 42500), Sulpho-Rhodamine B (CI 45100), Neutral Red (CI 50040), Safranine T (CI 50240).

Blue dyes:

Basic Blue 5 (CI 42140), Methylene Blue (CI 52015), Chromoxane Brilliant Blue (CI 43850), Victoria Blue 4R (CI 42563), Janus Blue (CI 12211).

Green dyes:

Astra Diamond green (CI 42040), James Green (CI 11050), Basic Green 4 (CI 42000), Azo Green (CI 42175).

Many dyes have what is known as daylight fluorescence, i.e. they absorb daylight in a specific frequency range and re-emit it at a lower frequency. With these it is therefore possible to obtain coloured toners which also fluoresce in daylight. In addition, these dyes are extremely suitable for giving a greater brilliance or brightness to toners which are coloured with colouring pigment but have an insufficient brilliance or brightness. It is also possible to obtain a shift of the shade with these dyes.

The toner particles according to the invention are generally prepared in three stages. First of all the magnetically attractable core is prepared, and it is then enveloped with the masking layer, and finally the enveloped cores are dyed by applying the required colour into and/or onto the masking layer. In certain cases the dyeing operation can be combined with the preceding stage, the application of the masking layer, as will be explained in detail hereinafter. Cores consisting of binder and magnetically attractable material can be obtained in known manner by distributing the required quantity of pulverulent magnetically attractable material in a melt of the binder (or binders) and, after cooling, grinding the solid mass to form particles of the required dimensions. The resulting particles are preferably then heated in a stream of hot gas e.g. air, and then cooled, with the result that the magnetically attractable material becomes completely enveloped with binder. In addition, the particles are given a spherical shape as a result of this treatment. The cores can also be prepared by dissolving binder in a solvent, distributing magnetically attractable material in the solution, then evaporating the solvent, and finally grinding the solid mass. Applicants have developed two methods of enveloping the magnetically attractable core with the masking layer, and both these methods give very good results. They are referred to hereinafter as the granulate method and the latex method.

In the granulate method a fine granulate consisting of particles of at most 3 μm, and preferably 1–3 μm, containing binder and finely divided reflecting pigment, together with cores consisting of binder and magnetically attractable material, is dispersed in a liquid in which the binder or at least one of the binders of the magnetically attractable core, and/or the binder of the granulate, softens but does not dissolve, and the dispersion is stirred, or otherwise agitated, at room temperature or slightly elevated temperature until the cores are completely enveloped with the granulate.

The liquid in which the granulate is dispersed and stirred together with the magnetically attractable cores is selected according to the type of binder present in the cores and/or the granulate. It may consist of an organic solvent or a mixture of organic solvents or a mixture of one or more organic solvents and water.

The granulate consisting of binder and finely divided reflecting pigment can be prepared in known manner by melting the binder, homogeneously distributing in the melt fine particle of reflecting pigment having the required particle size of about 0.2 μm, cooling the melt and then grinding the solid mass to form particles having a particle size of at most 3 μm, and preferably 1–3 μm. The reflecting pigment content of the granulate is generally 40–80% by weight.

In the latex method, a polymer latex in which reflecting pigment is finely dispersed is fed dropwise to a dispersion of magnetically attractable cores in a coagulant for the polymer latex. The polymer from the latex coagulates and precipitates on the magnetically attractable cores, thus forming an enveloping layer. The reflecting pigment previously dispersed in the polymer latex or together with the cores in the coagulant is in these conditions enclosed by the coagulating polymer. The polymer latex is an aqueous emulsion of fine polymer particles generally of a particle size of about 0.2 μm, this emulsion being stabilised by a surface-active agent. It can be prepared in known manner. Suitable preparation methods and examples of suitable latices are described in Netherlands patent application No. 7600868. The coagulant may consist of an aqueous electrolyte solution, e.g., an aqueous solution of common salt or a quaternary ammonium salt, of a mixture of water and one or more water-miscible organic solvents or solely of water-miscible organic solvent.

If the magnetically attractable core consists of binder and magnetically attractable material, the coagulant should of course be so selected that the core binder does not dissolve therein. The reflecting pigment is preferably dispersed in the polymer latex.

Particles consisting of a single magnetically attractable particle with a masking layer therearound can be prepared by spray-drying a polymer latex in which magnetically attractable particles of a size of 10–20 μm and fine particles of reflecting pigment have been dispersed.

The dyeing of the enveloped cores to give the particles the finally required colour can be carried out in various ways.

The colouring agent can be applied directly into and/or onto the masking layer or the reflecting layer can be enveloped with a colouring pigment-binder layer or a dye-binder layer. Colouring pigment can be applied into and/or onto a masking layer directly from a dispersion if the colouring pigment and the masking layer both have a relatively polar character. The blue, green and yellow colouring pigments most used are polar, while the preferably used masking layer based on titanium dioxide as reflecting pigment also has a relatively polar character. The direct application of relatively polar colouring pigment onto the relatively polar masking layer is effected by dispersing the cores enveloped with the masking layer, together with fine colouring pigment particles, in a liquid in which the binder of the masking layer is insoluble and stirring the dispersion at elevated temperature, at which the binder of the masking layer becomes slightly tacky, until sufficient colouring pigment is deposited on the masking layer. The composition of the liquid in which the enveloped cores are dispersed together with the colouring pigment can also be so selected that the binder of the masking layer does become tacky, but does not dissolve therein. Dyeing of the enveloped cores can then be carried out at ordinary temperature or at just a slightly elevated temperature. The colouring pigment can also be applied to the enveloped cores by heating a dry pulverulent mixture of enveloped cores and fine colouring pigment particles, with continuous intensive mixing (e.g. mixing in a fluidized bed), to a temperature at which the binder of the masking layer becomes tacky, or exposing such mixture to vapour of a solvent which softens the binder of the masking layer and makes it tacky.

The latex method is carried out as described above, the colouring pigment then being finely dispersed in the coagulant or in the polymer latex itself. The best results are obtained if the colouring pigment is dispersed in the polymer latex.

The binder in the colouring pigment-binder layer may be the same as the binder in the masking layer or another binder which has good adhesion to the masking layer. Dyes can also be applied to the masking layer in the form of a dye-binder layer by using the granulate or latex method. In the granulate method, of course, a granulate is used which consists of binder particles in which dye is dissolved. The granulate can be prepared by melting the binder, dissolving dye in the melt and, after cooling, grinding the solid mass into fine particles (preferably 1–3 μm). The granulate can also be obtained by spray-drying a solution of binder and dye.

Commercial products are also available (e.g. made by Day-Glo), but in that case one is restricted to the melamine-formaldehyde-sulphonamide or polyamide resins supplied, while in addition the material is still too coarse so that it should first be ground further into particles of at most 3 μm.

When the dye-binder layer is applied via the latex method, the dye is dissolved in the coagulant or in the polymer latex, and preferably in the polymer latex.

Direct dyeing of the masking layer with dye is possible if a cationic dye is used for the dyeing. The cationic dyes mostly belong to the group of basic dyes but there are also acid dyes derived from basic dyes, which have a cation as the colouring agent. The direct dyeing of the masking layer with cationic dye is effected by stirring the cores enveloped with a masking layer for some time in an aqueous solution of cationic dye. The great advantage of this dyeing method is the simplicity with still the possibility of making many different shades in bright colours. Dyeing with cationic dye also enables the dyeing process to be combined with the application of the masking layer. The dye is then added to the polymer latex by means of which the masking layer is applied around the magnetically attractable cores in the manner described hereinbefore.

It is difficult to predict what shade a specific dye will give on various materials. For example, the dye Maxilon Brilliantflavine 10 GFF (Basic Yellow 40) in various materials gives the following shades:

| | |
|---|---|
| Epoxy resin | Green-yellow with strong fluorescence |
| Styrene-butyl-methacrylate | Light yellow |
| Titanium dioxide | Pale yellow |
| Silica gel | Brilliant yellow without fluorescence |

Two dyes having the same chemical formula but differing in respect of after-treatment or manufacture may also give totally different shades. For example, the dye Rhodamine 6GDN in epoxy resin gives a blue-red colour; Rhodamine F5GL in epoxy resin, however, gives a brilliant orange colour. Both dyes, however, are Basic Red 1.

The coloured, magnetically attractable toner powder according to the invention can be used as a one-component developer powder for developing latent charge patterns or latent magnetic information patterns. The latent charge patterns can be formed in known manner on known insulating or photo-conductive materials. Known developing apparatus operating on the so-called magnetic brush developing principle can be used for developing the images. A suitable developing apparatus is described, inter alia, in U.K. Patent Specification No. 1,412,350.

When used as a one-component developer powder the toner powder may be mixed with conventional additives. For example, a small quantity of silica may be added to the toner powder in order to improve its flow properties. The resistivity of the toner powders according to the invention is generally $10^{11}$ to $10^{14}$ Ohm.m. In the development of latent charge patterns, it may in some cases be desirable, depending upon the kind of developing apparatus, the contact time between the toner powder and the charge pattern during development, and the nature of the material on which the charge pattern is formed, to lower the resistivity of the toner powder. Without having an adverse effect on the colour of the toner powder this can be done, for example, by depositing a colourless anti-static compound onto the surface of the coloured toner particles, e.g. in the manner described in U.K. Patent Specification No. 940,577, or by incorporating a quaternary ammonium salt in the masking layer and, if present, preferably also in the colouring pigment-binder layer or dye-binder layer, e.g. in the manner described in Netherlands Patent Application No. 7600868.

The invention will be further understood by reference to the following examples.

EXAMPLE 1

Prepartion of coloured toner powder using the latex method (a) Preparation of the magnetically attractable cores 40 g of epoxy resin (Epikote 1004 from Shell-Nederland) were melted and kept at a temperature between 100° and 130° C. 360 g of carbonyl iron (Type HF2 from B.A.S.F.-Germany) were homogeneously distributed in the melt. After the latter had been cooled to room temperature the resulting solid mass was ground and the particles having a particle size of between 9 and 35 μm were separated by screening. These particles were sprayed in a stream of hot air of about 500° C. and then recooled to room temperature. Spherical particles were obtained in this way, consisting of carbonyl iron particles completely enveloped with epoxy resin.

(b) Preparation of the polymer latex 18 g of sodium oleate in 500 ml of demineralised water were heated to 70° C. in a 5-neck 1-liter flask provided with a stirrer, cooler, dropping funnel, thermometer and a gas inlet tube, and kept at that temperature for a half-hour while nitrogen was introduced. A homogeneous mixture of 49 g of pre-distilled styrene, 42 g of butyl methacrylate and 4.2 g of dodecyl mercaptan, was then added via the dropping funnel. Polymerisation was started by the addition of 4 g of potassium peroxodisulphate, dissolved in 100 ml of demineralised water. After the mixture had been stirred for 5 hours at 70° C. with nitrogen being passed therethrough, the polymerisation reaction was complete. The resulting latex was stable for about two weeks at a temperature of 5° C.

(c) Application of the masking layer 20 g of titanium dioxide (Type RN59 from Kronos A. G. of Germany) were dispersed in 50 ml of demineralised water to which 2 g of (4,4'-disulphonic acid)-dinaphthyl methane-sodium salt (wetting agent) had been added. The homogeneous dispersion was added to 60 ml of 10% polymer latex produced in accordance with (b). The resulting dispersion of titanium dioxide in polymer latex was added dropwise over a period of 5 hours, at a temperature of about 40° C., to a continuously stirred dispersion of 40 g of the cores, produced in accordance with (a), in 220 ml of demineralised water, to which 0.1 g of (4,4'-disulphonic acid)-dinaphthyl methane-sodium salt and 9.6 g of sodium chloride had been added.

The magnetically attractable cores enveloped with a white masking layer were then separated from the liquid and dried to the air. The masking effect of various kinds of cores, expressed as the percentage reflection, was measured with respect to a white tile by means of a Gretag D122 densitometer. For cores consisting of iron dispersed in a binder the reflection percentage was 2%, for cores covered with $TiO_2$ without a binder the percentage was 6%. When $TiO_2$ was dispersed together with the iron in the binder, so that the $TiO_2$ was situated inside the core, a reflection percentage of about 11% was measured. The reflection percentage was 50–60% in the case of cores according to the invention enveloped with a $TiO_2$/binder layer. If the cores were also rounded prior to the application of the masking layer, the reflection percentage was 60–80%.

(d) Direct application of a blue pigment onto the enveloped cores produced in accordance with (c)

25 g of the enveloped cores produced in accordance with (c) were dispersed in 400 ml of demineralised water to which 0.2 g of (4,4'-disulphonic acid)-dinaphthyl-methane sodium salt had been added. A mixture of 2.5 g of Helio Fast Blue G.O. (a product from Bayer-Germany) and 0.25 g of (4,4'-disulphonic acid)-dinaphthyl-methane sodium salt in 30 ml of an ethanol (20% by volume)-water mixture, the mixture having been ground for 48 hours in a ball mill, was added to this dispersion. The resulting dispersion of cores and colouring pigment was stirred for 2 hours at 95° C. The coloured particles were separated from the liquid and dried to the air. A toner powder having a brilliant blue colour was obtained.

(e) Application of a blue pigment by means of the latex method onto the enveloped cores produced in accordance with (c)

2.5 g of Helio Fast Blue G.O. ground for 48 hours in a ball mill with 0.25 g of (4,4'-disulphonic acid)-dinaphthyl-methane sodium salt in 30 ml of demineralised water were dispersed in 25 ml of 10% latex produced in accordance with (b). This mixture was added over a period of 2 hours and at a temperature of 75° C. dropwise to a dispersion of 40 g of enveloped cores produced in accordance with (c) in 220 ml of demineralised water to which 0.1 g of (4,4'-disulphonic acid)-dinaphthyl-methane sodium salt and 9.6 g of common salt had been added. The blue-coloured toner particles were separated from the liquid and dried to the air.

In the same manner as described above a green toner powder was prepared using "Monastral Fast Green 6Y", and a yellow toner powder using "Acetanil yellow". A combination (50/50% by weight) of Monastral Fast Green 6Y and Acetanil yellow gave a toner powder of a light green colour. With the same method described above a red toner powder was prepared by using "Permanent Red FRR" and also by using "PV Fast Red".

(f) Direct dyeing with a cationic dye of the enveloped cores produced in accordance with (c)

20 g of enveloped cores produced in accordance with (c) were dispersed in 300 ml of demineralised water. Subsequently 2.5 g of Rhodamine B were added. The dispersion was then stirred for 2½ hours at room temperature. A bright violet coloured toner powder was obtained after filtration and drying.

(g) Dyeing by means of a latex coloured with a cationic dye 20 g of enveloped cores produced in accordance with (c) were dispersed in 400 ml of demineralised water in which 0.1 g of (4,4'-disulphonic acid)-dinaphthyl-methane sodium salt and 15 g of common salt had been dissolved. At a rate of about 25 ml per hour 60 ml of latex produced in accordance with (b) and saturated with Rhodamine 6 GDN, were then added dropwise and with continuous stirring, at a temperature of about 50° C. A red coloured toner powder was obtained after filtration and drying.

(h) Dyeing in combination with the application of the masking layer 40 g of cores produced in accordance with (a) were dispersed in 250 ml of demineralised water, to which 0.5 g (4,4'-disulphonic acid)-dinaphthyl-methane sodium salt and 9.6 g of common salt had been added. 20 g of titanium dioxide were dispersed in 50 ml of demineralised water. Then 1 g of Rhodamine 6 GDN and 1 g of (4,4'-disulphonic acid)-dinaphthyl-methane sodium salt were added. After the titanium dioxide had been dispersed, 60 ml of the latex prepared in accordance with (b) were added. The resulting latex/titanium dioxide dispersion was added dropwise and with continuous stirring to the dispersion of the cores. A toner having a red pastel colour was obtained after filtration and drying.

(i) Dyeing by means of a granulate coloured with a cationic dye 270 g of Epikote 1004 and 140 g of Epikote 1001 were kneaded in a ploughshare kneader and heated to 130° C. Thereafter 2 g of Rhodamine F5GL were added and kneading was continued for another two hours. After cooling, the solid mass was ground into particles having a particle size of between 1 and 3 μm. 20 g of the resulting granulate and 25 g of cores produced in accordance (c) were dispersed in 150 ml of an ethanol (20% by volume)-water mixture and the dispersion was ground for 8 hours at 25° C. in a ball mill. The resulting coloured toner particles were separated from the dispersion and dried to the air.

EXAMPLE II

Preparation of coloured toner powder using the granulate method (a) Preparation of the magnetically attractable cores 9–20 μm cores were prepared in the manner described under (a) in Example 1, consisting of 70% by weight of carbonyl iron (Type HF2 from BASF-Germany), 20% by weight of epoxy resin (Epikote 1001 from Shell-Nederland) and 10% by weight of epoxy resin (Epikote 1001 from Shell-Nederland).

(b) Application of the masking layer

A granulate of reflecting pigment and binder was prepared as follows: 16 g of epoxy resin (Epikote 1004 from Shell-Nederland) were melted and 24 g of titanium dioxide (Type RN59 from Kronos A.G. of Germany) were homogeneously distributed in the melt at a temperature of between 100° and 130° C. After cooling to room temperature, the solid mass was ground into particles having a size of between 1 and 3 μm. 25 g of the cores prepared according to I(a) were dispersed in 150 ml of an ethanol (20% by volume)-water mixture. To the dispersion 20 g of the granulate just prepared were added and the mixture was intensively mixed for 8 hours at a temperature of 25° C. in a ball mill. The cores now provided with a masking layer were then separated from the liquid and dried to the air.

(c) Application of the colouring pigment 25 g of the enveloped cores produced in accordance with II(b) were dispersed in 400 ml of water. A dispersion of 2.5 g Helio Fast Blue GO and 0.1 g of (4,4'-disulphonic acid)-dinaphthyl-methane sodium salt in 30 ml of water after grinding for 48 hours in a ball mill was added to this dispersion. The resulting mixture was intensively stirred for 2 hours at about 43° C. so that the colouring pigment could adhere onto the enveloped cores. The blue-coloured toner particles were separated from the liquid and dried to the air. To enable the colouring pigment to adhere more strongly to the masking layer the toner particles were sprayed in a stream of hot air of about 500° C. and then re-cooled. It was also possible to prepare green and yellow coloured toner powders by the above method, by using Monestral Fast Green 6Y and Acetanil yellow respectively as the colouring pigment. Dyeing of the enveloped cores produced in accordance with II(b) can also be carried out according to the granulate method described under (i) in Example I.

EXAMPLE III

A latent charge image was formed conventionally on a photo-sensitive element provided with a zinc oxide-binder layer as described in Example 2 of U.S. Pat. No. 4,013,783.

The resulting latent charge image was then developed by means of the red toner powder described in Example I(g). The toner powder was brought into contact with the photo-sensitive layer by means of a magnetic roller. The resulting image was then transferred by pressure onto plain white receiving paper (commercially available Océ plain paper) and fixed thereon by a combination of pressure and heat.

The above method was repeated using the green toner powder based on Monastral Fast Green 6Y as described in Example I(e) and using the blue toner powder as described in Example II(c). In all three cases bright brilliantly coloured copies were obtained.

Colour specifications of the three toner powders referred to were determined by means of an ICS micromatch spectrometer with a standard $D_{65}$ light source. The standard method applied is described inter alia in Principles of Color Technology (1966) by Billmeyer & Saltzmann.

Colour specifications were also determined in the same way of the images obtained after fixing on the white receiving paper and having a 60–80% covering degree.

The results thereof are given in the following Table which shows for each toner the measured XYZ tristimulus values of standard CIE colorimetric coordinates and the values of the Hunter coordinates L, a and b relating to visual perception. Explanations of the meaning of the parameters mentioned can also be found in the above publication.

| | Loose powder | | | Fixed image | | |
|---|---|---|---|---|---|---|
| Red toner in accordance with Ig | X = 16.1<br>L = 36.8 | Y = 9.4<br>a = 49.1 | Z = 2.5<br>b = 33.9 | X = 16.6<br>L = 39.8 | Y = 11.1<br>a = 39.5 | Z = 5.1<br>b = 23.7 |
| Green toner in accordance with Ie | X = 6.6<br>L = 41.7 | Y = 12.3<br>a = 43.5 | Z = 4.6<br>b = 29.6 | X = 11.1<br>L = 47.6 | Y = 16.5<br>a = 29.9 | Z = 10.8<br>b = 16.8 |
| Blue toner in accordance with IIc | X = 9.4<br>L = 40.8 | Y = 11.7<br>a = −13.2 | Z = 26.4<br>b = −27.3 | X = 16.9<br>L = 52.4 | Y = 20.5<br>a = −13.6 | Z = 40.9<br>b = 27.1 |

The developing and transfer properties of the toner powders according to the invention are of good quality; the copies obtained satisfy the requirements in respect of resistance to folding and wiping.

We claim:

1. A colored magnetically attractable toner powder the particles of which individually comprise a magnetically attractable core of between about 8 and about 35 μm in size consisting essentially of particulate magnetically attractable material substantially completely enveloped in binder, a masking layer enveloping said core, said layer consisting essentially of reflecting pigment of sub-micron particle size distributed substantially homogeneously in binder and applied in an amount sufficient to mask off substantially completely the color of said magnetically attractable material, and coloring material in and/or on the masking layer.

2. A toner powder according to claim 1, the particle size of said magnetically attractable material being of between 6 and 15 μm.

3. A toner powder according to claim 1, said core being substantially spherical.

4. A toner powder according to claim 1, 2, or 3, said reflecting pigment having a refractive index of at least 2.

5. A toner powder according to claim 4, said reflecting pigment being titanium dioxide in the anatase or rutile form.

6. A toner powder according to claim 1, 2, or 3, the particles of said reflecting pigment being of about 0.2 μm in size.

7. A toner powder according to claim 1, 2, or 3, said reflecting pigment having a refractive index of at least 2 and the particles thereof being of about 0.2 μm in size.

8. A toner powder according to claim 1, 2, or 3, said coloring material comprising a cationic dye.

9. A toner powder according to claim 8, said coloring material comprising a cationic dye.

10. A toner powder according to claim 1, 2, or 3, said coloring material comprising at least one cationic dye having daylight fluorescent properties.

11. A colored magnetically attractable toner powder the individual particles of which comprise:

a. a substantially spherical, magnetically attractable core of about 8 to 20 μm in diameter, said core consisting essentially of about 40 to 80% by weight of particulate magnetically attractable material of about 6 to 15 μm in particle size enveloped in about 20 to 60% by weight of a binder;

b. a masking layer of about 2.5 to 7.5 μm in thickness enveloping said core, said layer consisting essentially of reflecting pigment distributed substantially homogeneously in binder and applied in an amount sufficient to mask off substantially completely the color of said magnetically attractable material, said pigment having a refractive index of at least 2 and its particles being of the order of about 0.2 μm in size; and c. coloring material in and/or on said masking layer.

12. A toner powder according to claim 11, said reflecting pigment being titanium dioxide in the anatase or rutile form, said coloring material comprising a cationic dye.

13. A process for the preparation of colored magnetically attractable toner powder, which comprises enveloping particulate magnetically attractable material substantially completely in binder to form magnetically attractable cores substantially completely enveloped in binder, enveloping said cores each with a masking layer consisting essentially of reflecting pigment of sub-micron particle size distributed substantially homogeneously in binder and applied in an amount sufficient to mask off substantially completely the color of the core, and coloring the enveloped cores by applying coloring material in and/or onto the masking layer.

14. A process for the preparation of colored magnetically attractable toner powder, which comprises enveloping magnetically attractable cores each with a masking layer containing binder and reflecting pigment of sub-micron particle size and coloring the enveloped cores by applying coloring material in and/or onto the masking layer, said enveloping being effected by mixing said cores with granules composed essentially of binder and said reflecting pigment in a liquid in which said binder softens but does not dissolve.

15. A process for the preparation of colored magnetically attractable toner powder, which comprises enveloping magnetically attractable cores each with a masking layer containing binder and reflecting pigment of sub-micron particle size and coloring the enveloped cores by applying coloring material in and/or onto the masking layer, said enveloping being effected by adding a dispersion of said reflecting pigment in an aqueous polymer latex dropwise to a dispersion of said cores in a liquid that coagulates the polymer of said latex.

16. A process for the preparation of colored magnetically attractable toner powder, which comprises enveloping magnetically attractable cores each with a masking layer containing binder and reflecting pigment of sub-micron particle size and coloring the enveloped cores by applying coloring material in and/or onto the masking layer, said coloring being effectd by applying an aqueous solution of a cationic dye to the masking layer.

17. A process according to claim 16, said coloring being effected simultaneously with the enveloping of said cores with the masking layer.

18. A process for the preparation of colored magnetically attractable toner powder, which comprises enveloping magnetically attractable cores each with a masking layer containing binder and reflecting pigment of sub-micron particle size and coloring the enveloped cores by applying coloring material in and/or onto the masking layer, said coloring being effected by precipitating onto the masking layer from a polymer latex a polymer colored with cationic dye or pigment.

19. A toner powder according to claim 1, said coloring material comprising, in a coloring layer of pigment dispersed in a binder and applied onto said masking layer, pigment of a desired color and a daylight fluorescent dye enhancing the color brightness.

20. A process for developing into a colored powder image a latent electrostatic or magnetic information pattern, which comprises depositing onto said pattern particles of a toner powder according to claim 1, 12, or 19.

21. A process according to claim 13, said cores having been produced by heating in a hot gas stream and thereby rendering substantially spherical particles formed by grinding a solid dispersion of said magnetically attractable material in thermoplastic resin.

22. A process according to claim 14, said granules being of 1 to 3 μm in size and containing 40 to 80% by weight of reflecting pigment particles of the order of about 0.2 μm in size having a refractive index of at least 2.

23. A process according to claim 15, said polymer latex being an aqueous emulsion, stabilized by a surface-active agent, of polymer particles of the order of about 0.2 μm in size.

24. A process according to claim 15, said dispersion in an aqueous polymer latex having dye dissolved therein whereby said coloring is effected simultaneously with said enveloping of said cores.

25. A process according to claim 13, 21, or 22, said coloring being effected by mixing said enveloped cores with fine coloring pigment in a liquid in which the binder of said masking layer becomes tacky and adheres the coloring pigment to the masking layer.

* * * * *